United States Patent [19]

Yaguramaki

[11] Patent Number: 4,827,580

[45] Date of Patent: May 9, 1989

[54] LOCKABLE SLIDER

[75] Inventor: Iwao Yaguramaki, Namerikawa, Japan

[73] Assignee: Yoshida Kogyo K. K., Tokyo, Japan

[21] Appl. No.: 151,240

[22] Filed: Feb. 1, 1988

[30] Foreign Application Priority Data

Feb. 2, 1987 [JP] Japan ..... 62-14042[U]

[51] Int. Cl.[4] ..... A44B 19/30

[52] U.S. Cl. ..... 24/419; 24/421

[58] Field of Search ..... 24/419, 415, 418, 420, 24/421, 422, 423,

[56] References Cited

U.S. PATENT DOCUMENTS

| | | | |
|---|---|---|---|
| 1,778,338 | 10/1930 | Prentice | 24/421 |
| 1,922,257 | 8/1933 | Nicholson | 24/419 |
| 2,450,779 | 10/1948 | Brozek | 24/419 |
| 2,523,740 | 9/1950 | Ulrich et al. | 24/421 |

FOREIGN PATENT DOCUMENTS

| | | | |
|---|---|---|---|
| 437302 | 5/1949 | Italy | 24/421 |
| 49-131001 | 11/1974 | Japan . | |
| 656293 | 6/1986 | Switzerland | 24/415 |

*Primary Examiner*—Kenneth J. Dorner
*Assistant Examiner*—Laurie K. Cranmer
*Attorney, Agent, or Firm*—Hill, Van Santen, Steadman & Simpson

[57] ABSTRACT

A lockable slider for a slide fastener is disclosed which has a locking prong integral with a pull tab and engageable between two adjacent fastener elements. The locking prong has a rounded apex, an arcuate slide surface and a vertical lock surface, said slide surface extending a length greater than the space or pitch between adjacent elements such that the locking prong can move freely in sliding relation to the rows of fastener elements on the fastener when the latter is opened.

1 Claim, 4 Drawing Sheets

LOCKABLE SLIDER

BACKGROUND OF THE INVENTION

1. Field of the Invention

This invention relates to sliders for slide fasteners having a discrete formation of coupling elements and particularly to such a slider which has means of locking the same against movement.

2. Prior Art

Conventional sliders of the type described have encountered the problem that the pull tab would flip down flat bu its own gravity to lock the slider, and not knowing this, the user would spread the fastener stringers apart to open the fastener only to damage the coupling elements. With a view to overcoming this problem, there has been proposed a certain form of slider as disclosed in Japanese Laid-Open Utility Model Publication No. 49-131001 in which the slider is equipped with a pull tab having a locking prong of slightly modified trapezoidal shape designed to prevent the prong from spontaneously or accidentally falling in between adjacent fastener elements, this prior art slider being illustrated in FIGS. 8 and 9 of the accompanying drawing. A slide fastener with this type of slider on is opened by spreading its stringer halves apart, not by lifting and not manipulating the pull tab.

However, when it is desired to lock the slider at any point on the fastener, this would become difficult as the locking prong due to its trapezoidal shape tends to depress the fastener elements from above and cannot enter between the elements unless the slider is once adjusted in position by being pulled backwards.

SUMMARY OF THE INVENTION

It is therefore the primary object of the present invention to provide an improved slider for slide fastener which is free from spontaneous or accidental lock by its own gravity, smoothly slidable along the rows of fastener elements while the fastener stringers are spread open, and capable of positive lock on the fastener with utmost ease.

According to the present invention, there is provided a lockable slider for a slide fastener which has a locking prong integral with a pull tab and engageable between two adjacent fastener elements. The locking prong has a rounded apex, an arcuate slide surface and a vertical lock surface, the arcuate slide surface extending a length greater than the space or pitch between adjacent elements. The locking prong of this construction can move freely in sliding relation to the rows of fastener elements on the fastener when the latter is opened.

The above object and other features of the present invention will be better understood from the following detailed description taken in connection with the accompanying drawings in which like reference numerals refer to like or corresponding parts throughout the several views.

DETAILED DESCRIPTION OF THE INVENTION

Figure 1:
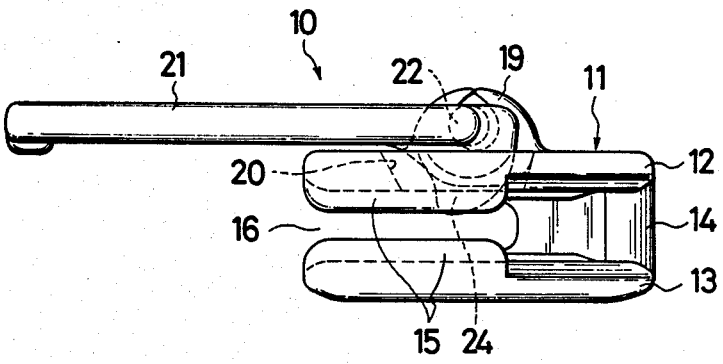
FIG. 1 is a side elevational view of a slider embodying the invention.
Figure 2:
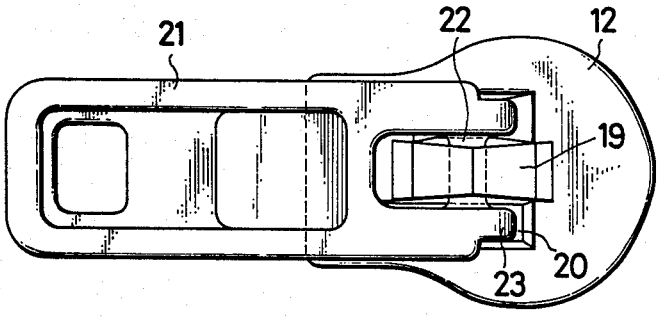
FIG. 2 is a plan view of the same.
Figure 7:
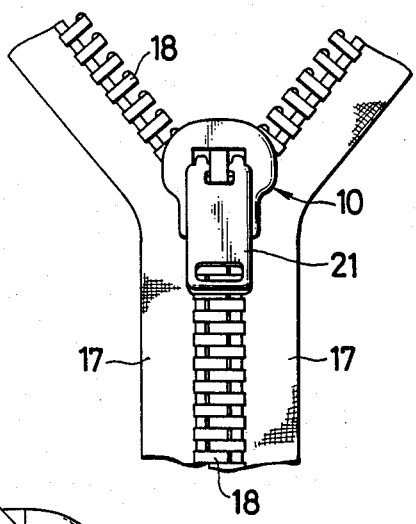
FIG. 7 is a segmental plan view of a slide fastener on which is mounted the slider of the invention.
Figure 8:
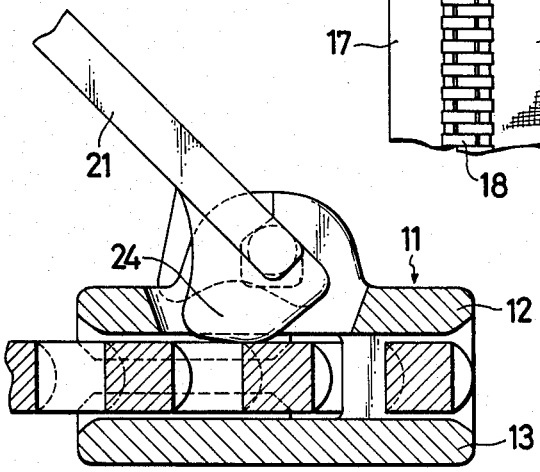
FIG. 8 PRIOR ART
FIG. 8 is a longitudinal cross-sectional view of a prior art slider in a position similar to that shown in FIG. 3.
Figure 9:
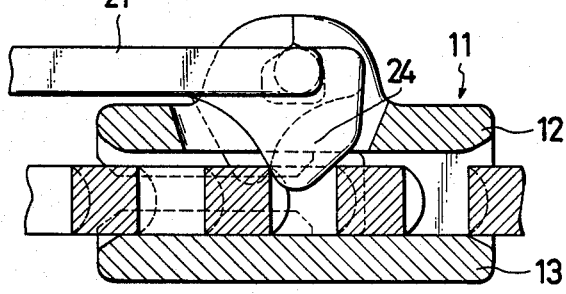
FIG. 9 PRIOR ART
FIG. 9 is a view of the prior art slider in a position similar to FIG. 4.

Referring now to the drawings and FIGS. 1 and 2 in particular, there is shown a lockable slider 10 for use on a slide fastener (FIG. 7). The slider 10 has a slider body 11 including upper and lower spaced parallel wings 12 and 13 which are joined at their front ends by a connecting neck 14 commonly known as a diamond head. The upper and lower wings 12 and 13 are generally similar in shape and inwardly flanged as at 15.

The upper and lower wings 12 and 13 of the slider 10 define therebetween a generally Y-shaped guide channel 16 for the passage therethrough of a pair of fastener stringers each including a support tape 17 and a row of coupling elements 18 of a discrete formation as better shown in FIG. 7.

A support lug 19 is formed centrally on the upper wing 12 and extends longitudinally over the length of an aperture 20 communicating with the guide channel 16.

A pull tab 21 has its spindle 22 pivotally connected to the support lug 19 and one of its shoulders 23 provided integrally wit a locking prong 24 which is movable through the aperture 20 into and out of the guide channel 16. The locking prong 24 has a rounded apex **24*a*, a sliding peripheral surface 24*b* extending arcuately upwardly from the apex 24*a* and a vertically extending lock surface 24*c*. The sliding arcuate surface 24*b* extends a length greater than the space or pitch P between adjacent coupling elements 18 so that the slider 10 is allowed to slide freely along the rows of elements 18 with the pull tab 21 lifted when spreading the fastener stringers open as shown in FIG. 7, the locking prong 24 otherwise being liable to intrude in between and thereby impairing the coupling elements 18**.

Figure 3:
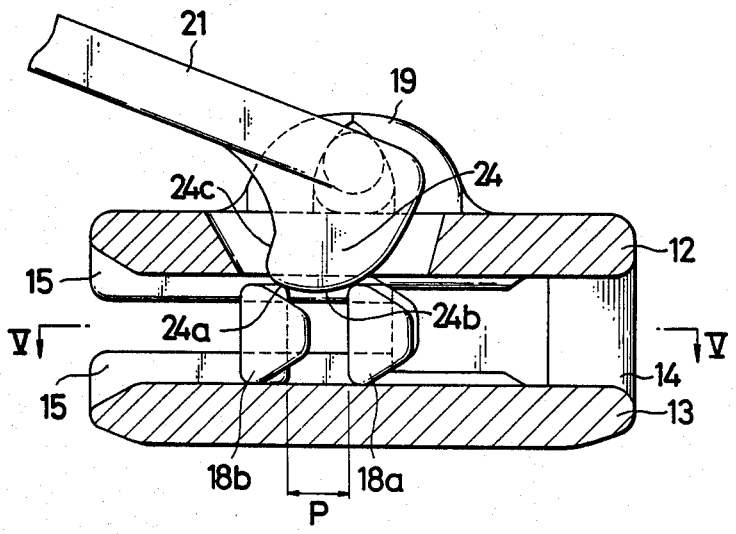
FIG. 3 is a longitudinal cross-sectional view on enlarged scale of the slider shown in unlocked position.
Figure 4:
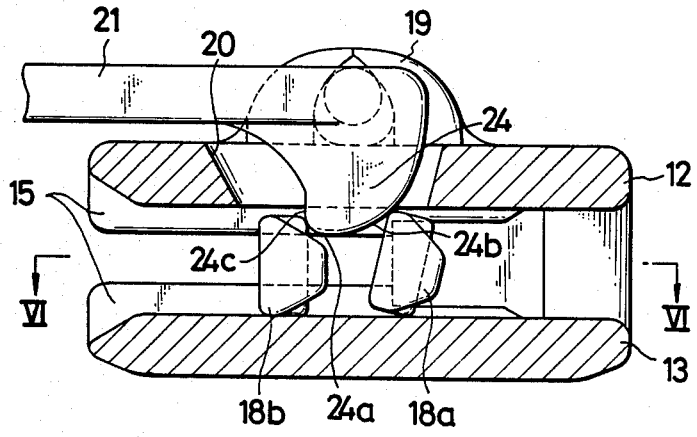
FIG. 4 is a view similar to FIG. 3 but showing the slider in locked position.
Figure 5:
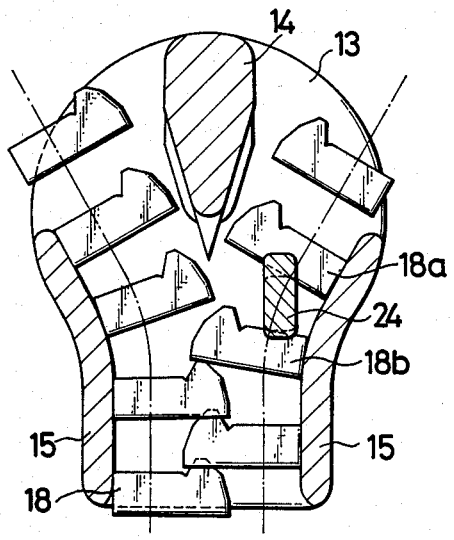
FIG. 5 is a cross-sectional view taken on the line V—V of FIG. 3.
Figure 6:
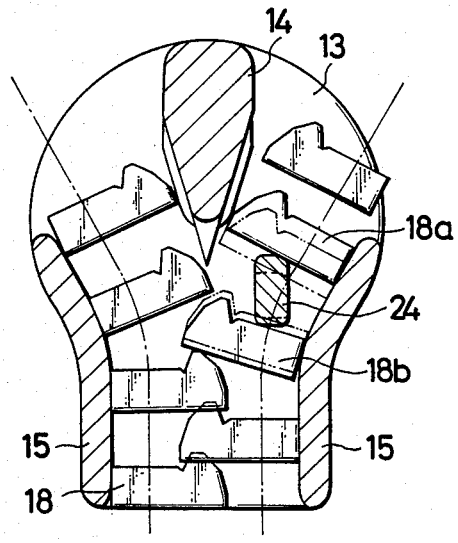
FIG. 6 is a cross-sectional view taken on the line VI—VI of FIG. 4.

When it is desired to lock the slider 10 positively against movement on the fastener, the pull tab 21 is rotated counterclockwise into a position parallel or flush with the plane of the slider 10 as shown in FIG. 4, in which position the arcuate slide surface **24*b* abuts against and pushes a preceding element 18*a* of two adjacent elements 18 from behind causing the same to tilt forwardly, while the vertical lock surface 24*c* is brought into abutting engagement with an ensueing element 18*b* as shown in FIGS. 4 and 6. The arcuate slide 24*b* is so contoured that the preceding element 18*a* is urged to tilt forwardly only to an extent necessary to enable the lock surface 24*c* to come into face-to-face engagement with the forward end wall of the ensueing element 18*b*, not to an extent to disrupt the normal pitch P of the row of elements 18, thus permitting the preceding element 18*a* to bounce readily back to its normal position (FIGS. 3 and 5) when released from the locking prong 24**.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A slide fastener comprising:

(a) a pair of stringer tapes each carrying on and along its inner edge a row of discrete coupling elements, said row of coupling elements having a pitch;

(b) a lockable slider comprising:

(i) a slider body including upper and lower wings spaced apart parallel to each other and joined together at their front ends to define a guide channel for the passage of the rows of coupling elements, said upper wing having an aperture communicating with said guide channel, (ii) a pull tab pivotally mounted on said upper wing of said slider body; and (iii) a locking prong integral with said pull tab and movable through said aperture into and out of said guide channel in response to pivotal movement of said pull tab, said locking prong having a rounded apex, a sliding peripheral surface extending arcuately upwardly from the front of said apex, and a vertically extending lock surface at the rear of said apex, said arcuate sliding peripheral surface having a length greater than the pitch of the coupling element row, such that said slider is allowed to slide freely along the rows of coupling elements without causing accidental intrusion of said locking prong in between adjacent coupling elements due to the effect of gravity on the pull tab when the slide fastener is forced to open and the pull tab lies at an angle to the upper wing, and when said pull tab lies flatwise against said upper wing, said arcuate sliding peripheral surface urges a preceding element to tilt forwardly such that said lock surface abuts flatwise against a succeeding coupling element.

* * * * *